US005092578A

United States Patent [19]

Bergmeier et al.

[11] Patent Number: 5,092,578

[45] Date of Patent: Mar. 3, 1992

[54] SHEET FEEDER IN A SHEET-PROCESSING MACHINE

[75] Inventors: Dieter Bergmeier; Jürgen Zeltner, both of Heidelberg, Fed. Rep. of Germany

[73] Assignee: Heidelberger Druckmaschinen AG, Heidelberg, Fed. Rep. of Germany

[21] Appl. No.: 693,329

[22] Filed: Apr. 29, 1991

[30] Foreign Application Priority Data

Apr. 27, 1990 [DE] Fed. Rep. of Germany ..... 4013494
Feb. 26, 1991 [DE] Fed. Rep. of Germany ..... 4105967

[51] Int. Cl.[5] ..... B65H 3/14

[52] U.S. Cl. ..... 271/97; 271/98; 271/104; 271/105; 271/106

[58] Field of Search ..... 271/11, 97, 98, 104, 271/105, 106

[56] References Cited

U.S. PATENT DOCUMENTS

| | | | |
|---|---|---|---|
| 2,085,612 | 6/1937 | Spiess | 271/98 |
| 3,294,396 | 12/1966 | Staines | 271/98 |
| 3,504,910 | 4/1970 | Spyropoulos | 271/98 |
| 3,938,800 | 2/1976 | Wirz | 271/98 X |
| 3,980,293 | 9/1976 | Shelmire | 271/98 X |
| 4,470,589 | 9/1984 | Singer | 271/98 X |

FOREIGN PATENT DOCUMENTS

| | | | |
|---|---|---|---|
| 1230812 | 12/1966 | Fed. Rep. of Germany | 271/97 |
| 3834400 | 4/1990 | Fed. Rep. of Germany | 271/97 |
| 9011240 | 10/1990 | World Int. Prop. O. | 271/97 |

*Primary Examiner*—Robert P. Olszewski
*Assistant Examiner*—Boris Milef
*Attorney, Agent, or Firm*—Herbert L. Lerner; Laurence A. Greenberg

[57] ABSTRACT

A sheet feeder in a sheet-processing machine, comprising first blower nozzles for fanning and separating a top sheet of a sheet pile, the blower nozzles being directed at least at a rear edge of the top sheet in the sheet pile, a separating device for lifting the top sheet from the sheet pile, second blower nozzles for blowing supporting air under the top sheet in synchronism with an operating cycle of the sheet feeder, central blast-air supply system for the sheet feeder being connected to the first blower nozzles, and a blast-air source separate from the central blast-air supply system connected via a control valve to the second blower nozzles for supplying blast air thereto for supporting the sheet, and a device for operating the control valve in synchronism with the separating device.

4 Claims, 5 Drawing Sheets

SHEET FEEDER IN A SHEET-PROCESSING MACHINE

The invention relates to a sheet feeder in a sheet-processing machine and, more particularly, a sheet-fed rotary printing press, the sheet feeder having a separating device for lifting a top sheet from a sheet pile and blower nozzles for fanning and for supporting the top sheet.

A sheet feeder of this general sort has become known heretofore from German Published Non-Prosecuted Application (DE-OS) 36 09 550. In this arrangement, adjustable blowing nozzles for separating the top sheet are mounted adjacent one another in a row, at a level of the top sheet in the sheet pile, and are directed at the rear or trailing edge of the top sheet. The blowing nozzles are continuously supplied with blast air from a central blast air source. Additional blowing nozzles of different construction are also provided. The supply to the additional blowing nozzles is adjustable to synchronize with the operating cycle of the sheet feeder in order to form a type of air cushion formed of supporting air for the top sheet which is lifted by the separating device formed as separator suckers. In order to adapt to different sheet material, especially to different paper qualities, the level or height and the direction of action of the nozzles and of the airflow are adjustable, and the appropriate shape of the nozzle is selected accordingly. Notwithstanding such measures, it sometimes happens, particularly during increases in the machine speed, that the rear or trailing edges and/or the front or leading edges of sheets in the sheet pile do not detach themselves from one another, and sheets are not properly collected by the conveyors which transport them into the sheet feeder, or multiple sheets are caused to enter the feeder and trigger a machine stop. Heavy paper grades, in particular, for example cardboard or pasteboard, tend to become warped, which prevents the sheet which is to be lifted from lying tightly on the separator sucker. But even when firmly-seated thin paper grades are used, the operational liability of the feeder function is limited. Supporting air is not blown far enough beneath the topmost sheet which is lifted at its rear or trailing edge, so that the conveyance or transport thereof is not assured.

For the purpose of achieving better holding or support of the sheet after it has been lifted from the sheet pile, as well as improved functioning of the sheet feeder, it has become known heretofore from German Patent 1 699 507, to increase the number of separator suckers and also to provide an increased number of forwarding suckers which are arranged behind one another, in the direction of sheet conveyance, in several rows extending over the width of the sheet. This known solution, however, involves considerable extra expense, and the air requirements thereof, and thus the energy demand, are accordingly greater.

It is accordingly an object of the invention to provide a sheet feeder in a sheet-processing machine, such as a printing press, of the foregoing general type, in which, by cost-efficient methods and with less expenditure of energy, an increased operational reliability of the feeder irrespective of the quality of the sheet material to be processed, and an increase in the printing speed are achieved.

With the foregoing and other objects in view, there is provided, in accordance with the invention, a sheet feeder in a sheet-processing machine, comprising first blower nozzles for fanning and separating a top sheet of the sheet pile, the blower nozzles being directed at least at a rear edge of the top sheet from the sheet pile, second blower nozzles for blowing supporting air under the to sheet in synchronism with an operating cycle f the sheet feeder, a central blast-air supply system for the sheet feeder being connected to the first blower nozzles, and a blast-air source separate from the central blast-air supply system connected via a control valve to the second blower nozzles for supplying blast air thereto for supporting the sheet, and means for operating the control valve in synchronism with the separating device.

In order to separate the rear edge of the topmost sheet from the sheet pile, these structural features permit separate blast air to be advantageously blow, in repeated blasts, into the pile by fanning blowers in synchronism with the operating cycle of the sheet feeder. The separate blast air is under a pressure which is higher than that of the central air and originates from a blast air source which is independent of the general blast air supply of the feeder. The sheet is lifted at the rear edge thereof by a suitable separating device in a conventional manner. Supporting air under relatively high pressure from the separate blast air source is blown under this lifted sheet in synchronism with the operating cycle of the machine, so that full separation of this sheet from the next sheet lying thereunder, up to the very front or leading edge of the sheet is achieved with an operational reliability which is considerably greater than heretofore known in the art. The air cushion thereby produced can be individually defined to correspond with requirements dependent upon the sheet material and the machine speed, and can therefore be formed in a more optimal manner than has been known heretofore. In the case of sheet feeders which have a suction head with a feeler foot which can be placed on the rear or trailing edge of the topmost sheet in the sheet pile and via which supporting air is normally blown under the topmost sheet, supporting air from the separate blast-air source is advantageously emitted via the nozzles in this feeler foot and via further supporting-air nozzles arranged adjacent thereto, the supporting air being directable diagonally or at an inclination from the center of the sheet towards the side thereof in a generally conventional manner, or possibly also via only one of these two types of blower nozzles.

In accordance with another feature of the invention, the sheet feeder includes an inwardly and outwardly swingable feeler foot, and drive means for placing the feeler foot periodically in synchronism with the operating cycle of the sheet feeder on the rear edge of the top sheet in the sheet pile, the operating means for the control valve being coupled with the drive means for the feeler foot.

Thus, the supporting-air nozzles in the feeler foot and in supporting-air blowers and the fanning blowers are advantageously supplied with separate blast air by a relatively small compressor via a control valve which is constructed as a turning or rotary valve and coupled with the drive of the suction head and, in particular, with drive elements of the feeder foot. This feature presents a special advantage because it facilitates operation of the turning valve in synchronism with the drive elements of the suction head, and especially of the feeler foot, and the blowing times for the separate blast air can be more exactly determined and if necessary adjusted so that extremely short time periods are obtained. In addition, due to the separate supplying of blast air to the blower nozzles for the supporting air and for the separating air, the respective blower nozzles can be individually and independently controlled, because this separate blast air does not depend on the conditions of the general blast-air supply. In particular, this separate blast-air supply system for the blowing of air under and the separation of the lifted sheet permits higher pressures, with reduced blowing times, if necessary or desirable. The general blast-air generating system does not have to generate the relatively higher pressure, but rather, can operate with reduced or lower pressure, if necessary, which represents n economic advantage.

In accordance with a further feature of the invention, the sheet feeder includes means for supplying air to the second blower nozzles intermittently.

In accordance with a concomitant feature of the invention, the sheet feeder includes third blower nozzles disposed at a rear side of the sheet pile adjacent the first blower nozzles which are connected to the separate blast-air source for receiving a continuous supply of blast air therefrom in synchronism with the operating cycle of the sheet feeder, and means for optionally also connecting the third blowers to the separate blast-air source.

In an advantageous development of the inventive concept, thus, some of the blowers provided in the vicinity of the rear edge of the top sheet of the sheet pile can also be connected to the separate blast-air supply. Due to the availability of a higher pressure, an increased flexibility in adapting to special operating conditions is afforded.

The supply of separate blast air to the blowing nozzles which blow supporting air under the lifted top sheet not only increases operating reliability but also reduces the required volume of air because shorter blowing times are possible and the general blast-air supply system can operate at lower pressure. A lower energy consumption thus occurs, and the environment is eased or relieved thereby.

Other features which are considered as characteristic for the invention are set forth in the appended claims.

Although the invention is illustrated and described herein as embodied in a sheet feeder in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
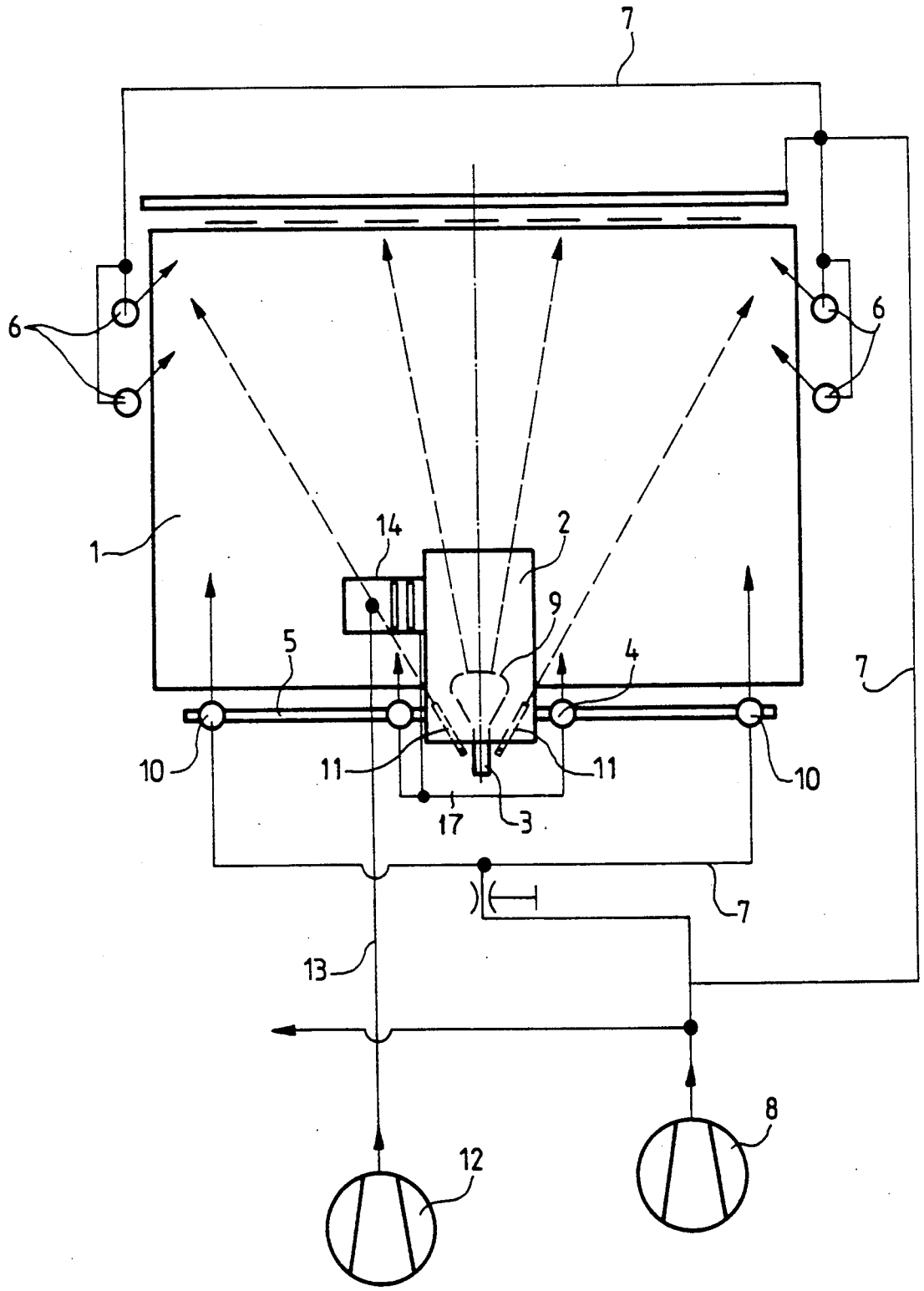
FIG. 1 is a diagrammatic and schematic top plan view of a sheet feeder constructed in accordance with the invention and including a circuit diagram for an air supply therefor.
Figure 2:
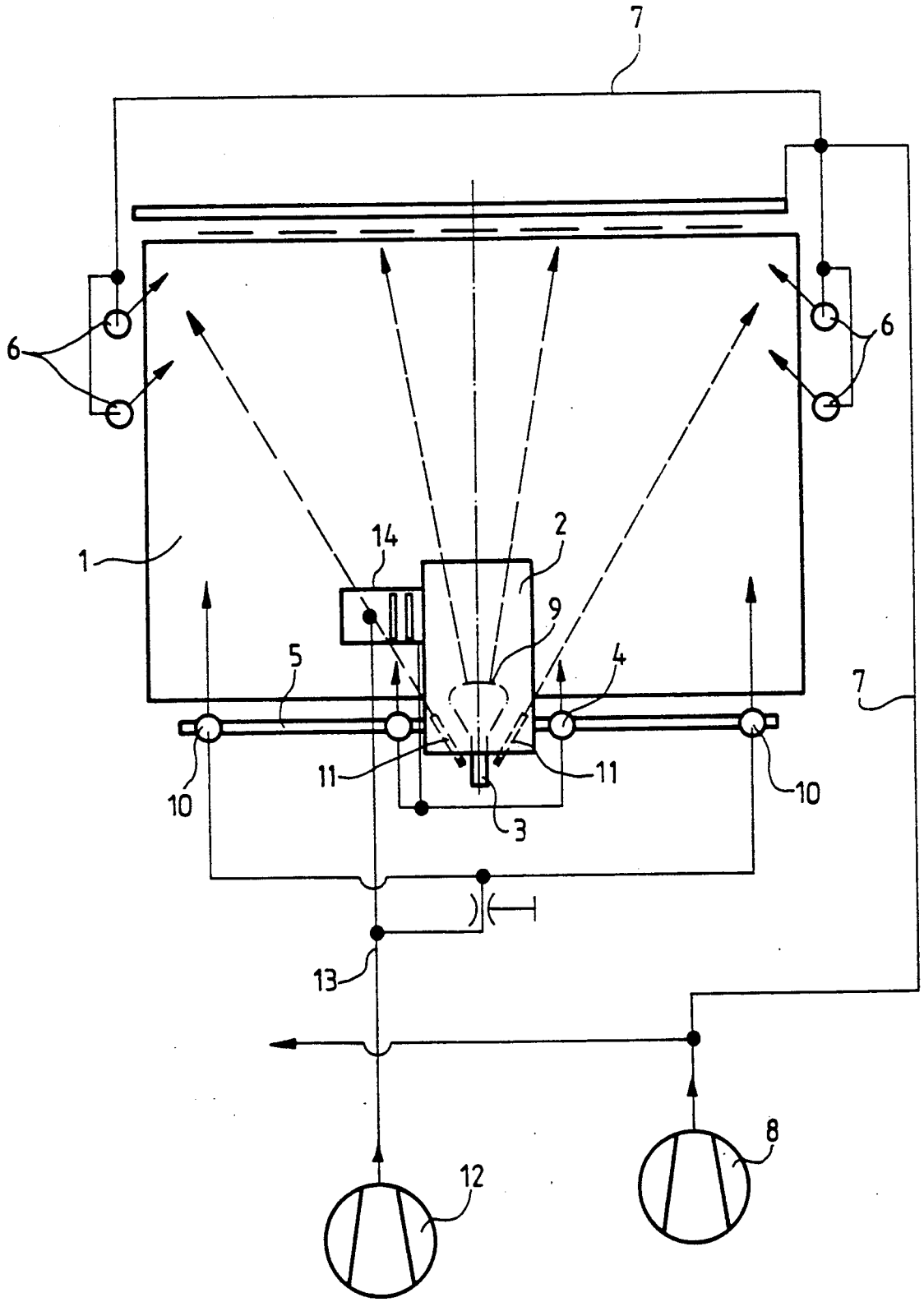
FIG. 2 is a view corresponding to that of FIG. 1, with a circuit diagram for another embodiment of the air supply.
Figure 4:
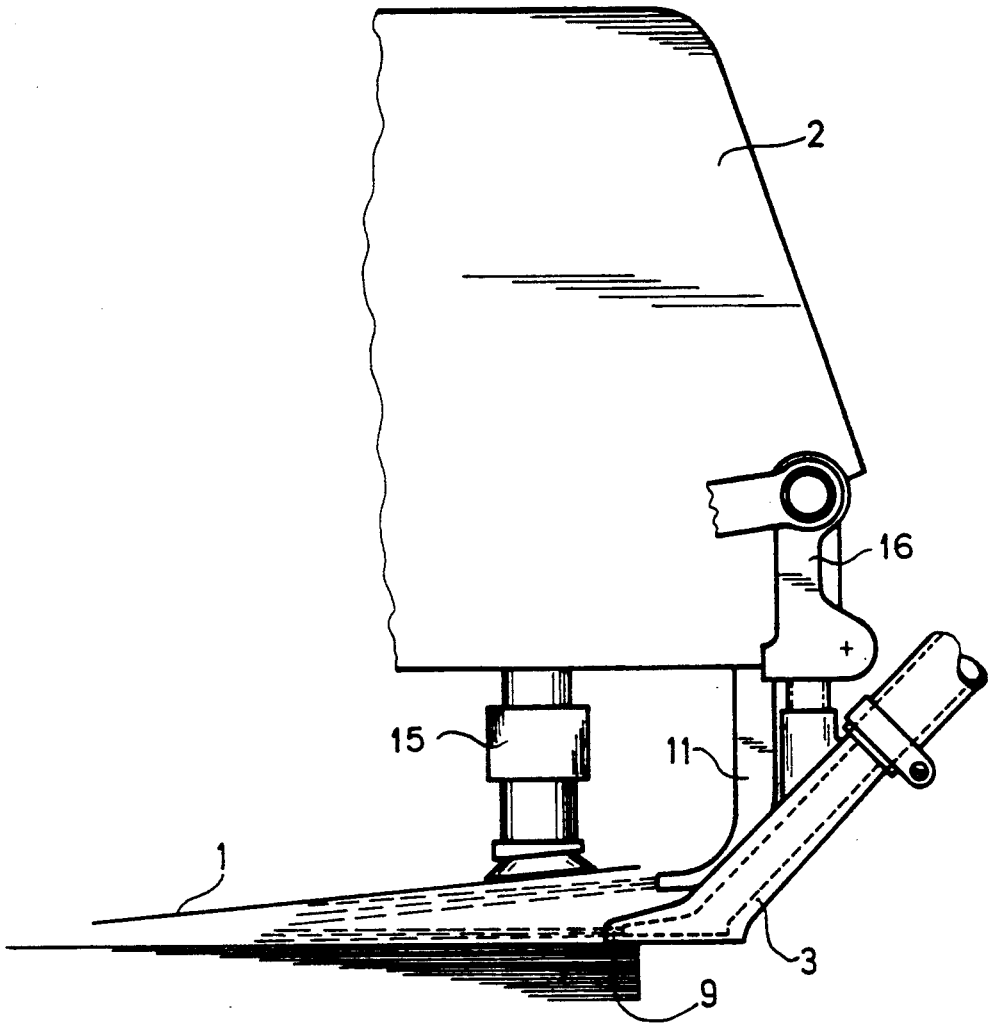
FIG. 4 is a sectional view of FIG. 3 taken along the line IV—IV in the direction of the arrows.

Referring now to the drawings and, first, particularly to FIGS. 1 and 2 thereof, there is shown therein, in a top plan view, a top sheet 1 of a sheet pile and a suction head 2 of a sheet feeder according to the invention represented in a block diagram. Located at an underside of the suction head 2 is a feeler foot 3 which is driven by drive means 16 in synchronism with an operating cycle of the sheet feeder. In the interest of clarity, a separating device formed, fore example, of one or more separator suckers 15 for lifting the top sheet from the sheet pile is only shown diagrammatically in FIG. 4 of the drawings. This separating device 15 is of conventional construction.

Figure 3:
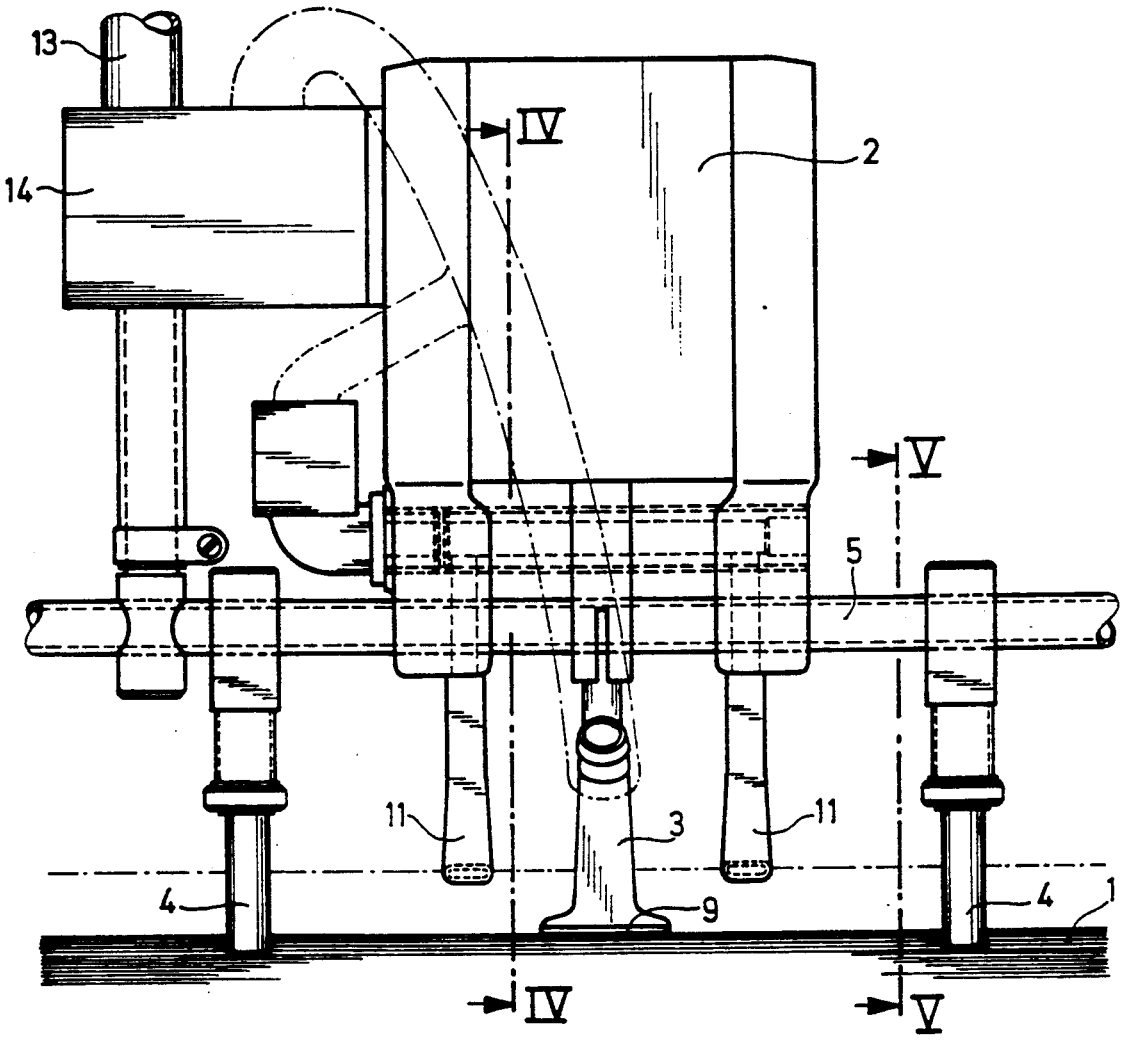
FIG. 3 is an enlarged, fragmentary rear elevational view of FIG. 1, as seen from the bottom thereof, and showing blowing nozzles acting upon a rear or trailing edge of a sheet.
Figure 5:
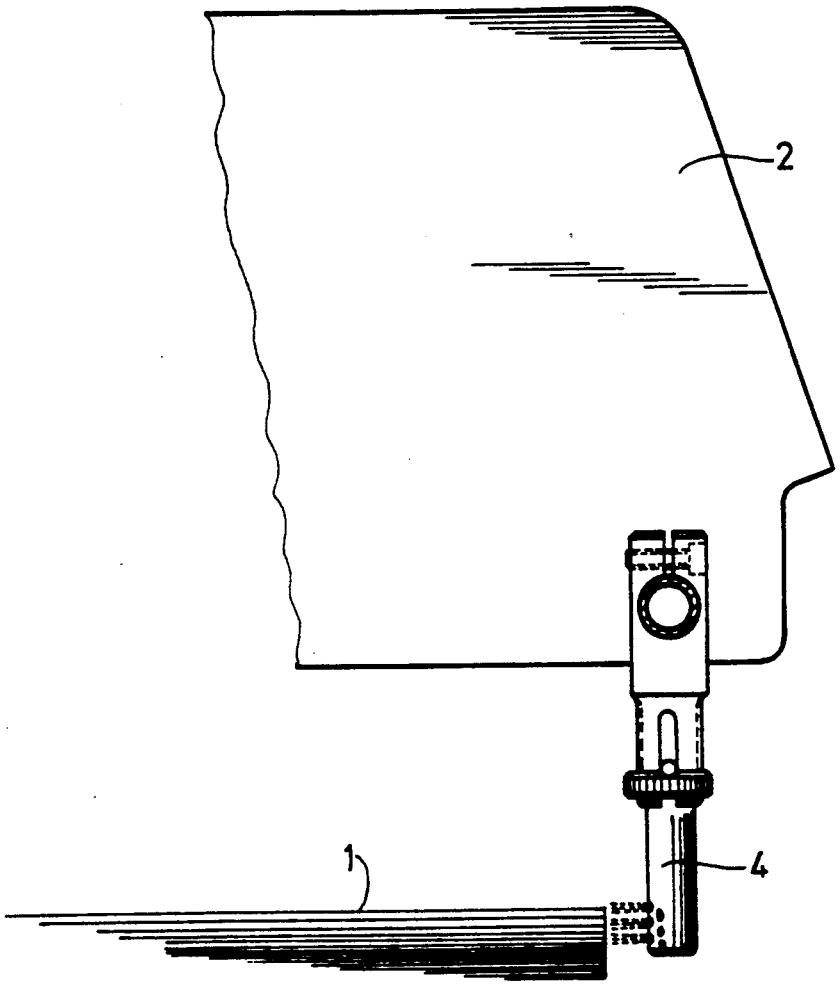
FIG. 5 is a sectional view of FIG. 3 taken along the line V—V in the direction of the arrows.

In the vicinity of the rear or trailing edge of the upper sheet 1 of the sheet pile, fanning blowers 4 (also not FIGS. 3 and 5) which are adjustable laterally and vertically and which are directed at the rear edge of the sheet 1 are arranged in a row adjacent one another on a transverse pipe 5. Also on the pipe 5, offset from the center thereof toward the outside, vertically adjustable rear-edge blowers 10 are arranged as fanning blowers for separating the top sheet. Diagonal blowers 6 are additionally provided alongside the sheet pile, in the vicinity of the top sheets. In the circuit diagram of FIG. 1, the rear-edge blowers 10 as well as the diagonal blowers 6 are continuously supplied, via feeding pipes 7, with blast air from a central air supply system 8 or from another blast-air source. A separate blast-air supply is provided by a compressor 12 for the blowing nozzles 9 in the feeler foot 3 (also note FIGS. 3 and 4) as well as for two or more laterally adjacent supporting-air blowers 11 which are, in the example, directed diagonally or at an inclination towards the outside, and for the fanning blowers 4. The compressor 12 operates with a relatively high pressure, has an output which is considerably smaller than that of the central air supply system 8, and is controlled independently of the central air supply system 8. The rear-edge blowers 10 can also be supplied with separate blast air, when necessary, however, the blast air from the separate compressor 12 is supplied through a feeding pipe 13 via a turning valve 14 by which it is controlled, the turning valve 14 being coupled with driving elements of the suction head 2 and preferably with driving elements of the feeler foot 3, so that the turning valve 14 rotates in synchronism with the movement of the feeler foot 3 and permits the separate blast air in the nozzles 9 and the blowers 11 to be exactly controlled. Turning valve 14 is also connected to fanning blowers 4 through connection 17.

According to the circuit diagram in FIG. 2, nozzles in the rear-edge blowers 10 can also be supplied with the separate blast air from the compressor 12 or from another source, when necessary, if increased operating reliability during separation and, in particular, during lifting of the topmost sheet from the sheet pile can be achieved thereby.

The foregoing is a description corresponding in substance to German Application P 40 13 494.6, dated Apr. 27, 1990 and German Application P 41 05 967.0, dated Feb. 26, 1991, the International priorities of which are being claimed for the instant application, and which are hereby made part of this application. Any material discrepancies between the foregoing specification and the aforementioned corresponding German applications are to be resolved in favor of the latter.

We claim:

1. Sheet feeder in a sheet-processing machine, comprising first blower nozzles for fanning and separating a top sheet of a sheet pile, said blower nozzles being directed at least at a rear edge of the top sheet in the sheet pile, a separating device for lifting the top sheet from the sheet pile, second blower nozzles for blowing supporting air under the top sheet in synchronism with an operating cycle of the sheet feeder, a central blast-air supply system for the sheet feeder being connected to a first plurality of said first blower nozzles, and another blast-air source separate from said central blast-air supply system connected via a control valve to said second blower nozzles for supplying blast air thereto for supporting the sheet, said control valve being operated in synchronism with said separating device.

2. Sheet feeder according to claim 1, including an inwardly and outwardly swingable feeler foot, and drive means for placing said feeler foot periodically in synchronism with the operating cycle of the sheet feeder on the rear edge of the top sheet in the sheet pile.

3. Sheet feeder according to claim 1, wherein a second plurality of said first blower nozzles is disposed at a rear side of the sheet pile adjacent at least some of said first plurality of first blower nozzles and being also connected via said control valve to said other blast-air source for receiving a supply of blast air therefrom in synchronism with the operating cycle of the sheet feeder.

4. Sheet feeder according to claim 1, including means for connecting others of said plurality of first blower nozzles to said other blast-air source.

* * * * *